US010128557B2

(12) United States Patent
Bae et al.

(10) Patent No.: US 10,128,557 B2
(45) Date of Patent: Nov. 13, 2018

(54) CHIP-TO-CHIP INTERFACE COMPRISING A MICROSTRIP CIRCUIT TO WAVEGUIDE TRANSITION HAVING AN EMITTING PATCH

(71) Applicant: Korea Advanced Institute of Science and Technology, Daejeon (KR)

(72) Inventors: Hyeon Min Bae, Daejeon (KR); Ha Il Song, Daejeon (KR); HuXian Jin, Daejeon (KR); Joon Yeong Lee, Daejeon (KR); Hyo Sup Won, Daejeon (KR); Tae Hoon Yoon, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 15/342,551

(22) Filed: Nov. 3, 2016

(65) Prior Publication Data

US 2017/0141450 A1 May 18, 2017

(30) Foreign Application Priority Data

Nov. 12, 2015 (KR) ..... 10-2015-0158993
Aug. 17, 2016 (KR) ..... 10-2016-0104348

(51) Int. Cl.
*H01P 5/107* (2006.01)
*H01P 5/08* (2006.01)
(Continued)

(52) U.S. Cl.
CPC ..... *H01P 5/107* (2013.01); *H01P 3/081* (2013.01); *H01P 3/122* (2013.01); *H01P 3/16* (2013.01); *H01P 5/087* (2013.01)

(58) Field of Classification Search
CPC ..... H01P 5/107; H01P 3/122
(Continued)

(56) References Cited

U.S. PATENT DOCUMENTS 6,239,669 B1 * 5/2001 Koriyama et al. ..... H01L 23/66 333/247
6,580,335 B1 * 6/2003 Iizuka et al. ..... H01P 5/107 333/26
(Continued)

OTHER PUBLICATIONS

Ha Il Song, Huxian Jin & Hyeon-Min Bae, Plastic Straw: Future of High-Speed Signaling, Scientific Reports, http://www.nature.com/scientificreports.com, published Nov. 3, 2015.

*Primary Examiner* — Benny Lee
(74) *Attorney, Agent, or Firm* — Dinsmore & Shohl LLP

(57) ABSTRACT

The present invention relates to a microstrip circuit and a chip-to-chip interface apparatus comprising the same. According to one aspect of the invention, there is provided a microstrip circuit. The microstrip circuit includes a feeding line providing a signal, a probe being connected to one end of the feeding line, and a patch emitting the signal to a waveguide. The patch is disposed in a layer opposite to a layer in which the feeding line and the probe are disposed, with a core substrate being positioned therebetween. At least one of length of the probe, thickness of the core substrate, and permittivity of the core substrate is determined based on bandwidth of a transition between the microstrip circuit and the waveguide.

10 Claims, 6 Drawing Sheets

(51) Int. Cl.
*H01P 3/08* (2006.01)
*H01P 3/16* (2006.01)
*H01P 3/12* (2006.01)

(58) Field of Classification Search
USPC ..... 333/26, 239
See application file for complete search history.

(56) References Cited

U.S. PATENT DOCUMENTS

2007/0262828 A1* 11/2007 Fujita ..... H01P 5/107
333/26
2014/0184351 A1* 7/2014 Bae et al. ..... H01P 3/122
333/34
2014/0368301 A1* 12/2014 Herbsommer et al. ... H01P 3/16
333/239

* cited by examiner

CHIP-TO-CHIP INTERFACE COMPRISING A MICROSTRIP CIRCUIT TO WAVEGUIDE TRANSITION HAVING AN EMITTING PATCH

CROSS-REFERENCE TO RELATED APPLICATIONS

This application claim priority to Korean Patent Application No. 10-2015-0158993, filed on Nov. 12, 2015, and Korean Patent Application No. 10-2016-0104348, filed on Aug. 17, 2016, the entire contents of which are hereby incorporated by reference.

FIELD OF THE INVENTION

The present invention relates to a microstrip circuit and a chip-to-chip interface apparatus comprising the same.

BACKGROUND

As data traffic is rapidly increased, data transmission/receipt speed of I/O bus connecting integrated circuits is also being quickly increased. Over recent decades, conductor-based interconnects (e.g., copper wires) with high cost and power efficiencies have been widely applied to wired communication systems. However, such conductor-based interconnects have inherent limitations in channel bandwidth due to skin effect caused by electromagnetic induction.

Meanwhile, optic-based interconnects with high data transmission/receipt speed have been introduced and widely used as an alternative to the conductor-based interconnects. However, the optic-based interconnects have limitations in that they cannot completely replace the conductor-based interconnects because the costs of installation and maintenance thereof are very high.

Recently, a new type of interconnect has been introduced, which comprises a dielectric part in the form of a core and a metal part in the form of a thin cladding surrounding the dielectric part. Since the new type of interconnect (so-called e-tube) has advantages of both of metal and dielectric, it has high cost and power efficiencies and enables high-speed data communication within a short range. Thus, it has been spotlighted as an interconnect employable in chip-to-chip communication.

In this regard, the inventor(s) present a technique for a microstrip circuit to increase bandwidth of a signal transmission channel in a chip-to-chip apparatus including an e-tube.

SUMMARY OF THE INVENTION

One object of the present invention is to solve all the above-described problems.

Another object of the invention is to provide a microstrip circuit comprising a feeding line providing a signal, a probe being connected to one end of the feeding line, and a patch emitting the signal to a waveguide, the patch being disposed in a layer opposite to a layer in which the feeding line and the probe are disposed, with a core substrate being positioned therebetween, wherein at least one of length of the probe, thickness of the core substrate, and permittivity of the core substrate is determined based on bandwidth of a transition between the microstrip circuit and the waveguide, thereby increasing the bandwidth of the transition between the waveguide and the microstrip circuit.

According to one aspect of the invention to achieve the objects as described above, there is provided a microstrip circuit, comprising: a feeding line providing a signal; a probe being connected to one end of the feeding line; and a patch emitting the signal to a waveguide, the patch being disposed in a layer opposite to a layer in which the feeding line and the probe are disposed, with a core substrate being positioned therebetween, wherein at least one of length of the probe, thickness of the core substrate, and permittivity of the core substrate is determined based on bandwidth of a transition between the microstrip circuit and the waveguide.

According to another aspect of the invention, there is provided a chip-to-chip interface apparatus, comprising: the microstrip circuit; and a waveguide being coupled to the microstrip circuit, the waveguide comprising a dielectric part comprising a first and a second dielectric part having different permittivity, and a metal part surrounding the dielectric part.

In addition, there are further provided other microstrip circuits and chip-to-chip interface apparatuses comprising the same to implement the invention.

According to the invention, the bandwidth of a transition between a waveguide and a microstrip circuit may be increased.

According to the invention, a microstrip circuit may be further downsized due to the reduced size of components such as a probe, a slot, and a patch.

DETAILED DESCRIPTION OF THE INVENTION

Figure 1A:
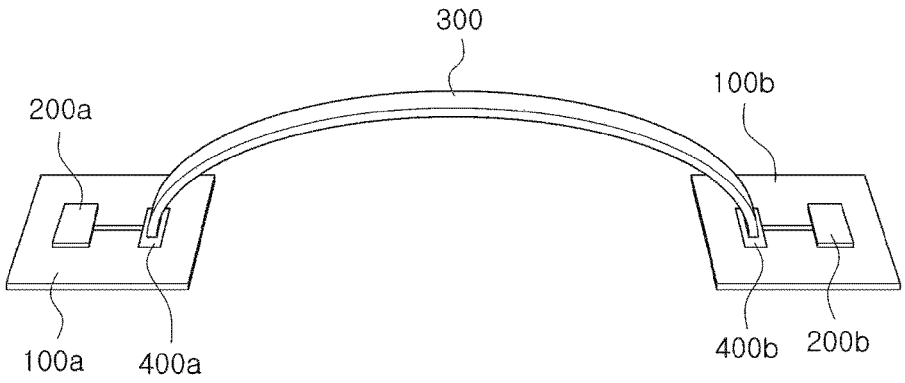
FIGS. 1A and 1B illustratively shows the schematic configuration and abstracted model of a chip-to-chip interface apparatus interconnected with a two-port network according to one embodiment of the invention.

In the following detailed description of the present invention, references are made to the accompanying drawings that show, by way of illustration, specific embodiments in which the invention may be practiced. These embodiments are described in sufficient detail to enable those skilled in the art to practice the invention. It is to be understood that the various embodiments of the invention, although different from each other, are not necessarily mutually exclusive. For example, specific shapes, structures and characteristics described herein may be implemented as modified from one embodiment to another without departing from the spirit and scope of the invention. Furthermore, it shall be understood that the locations or arrangements of individual elements within each of the disclosed embodiments may also be modified without departing from the spirit and scope of the invention. Therefore, the following detailed description is not to be taken in a limiting sense, and the scope of the invention, if properly described, is limited only by the appended claims together with all equivalents thereof. In the drawings, like reference numerals refer to the same or similar functions throughout the several views.

Hereinafter, preferred embodiments of the present invention will be described in detail with reference to the accompanying drawings to enable those skilled in the art to easily implement the invention.

Configuration of a Chip-to-Chip Interface Apparatus

Figure 1B:
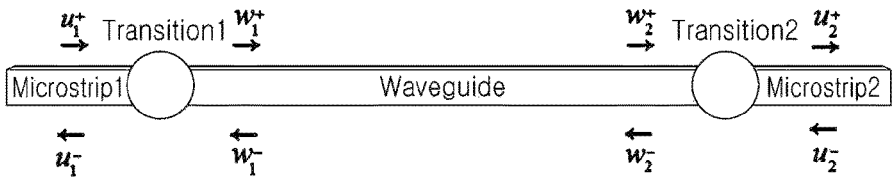

FIGS. 1A and 1B illustratively show the schematic configuration and abstracted model of a chip-to-chip interface apparatus interconnected with a two-port network according to one embodiment of the invention.

First, referring to FIG. 1A, a chip-to-chip interface apparatus according to one embodiment of the invention may comprise: a waveguide 300, which is an interconnect means for transmission of electromagnetic wave signals (e.g., data communication) between two chips 200*a*, 200*b* each present in two different boards 100*a*, 100*b* or present in a single board (not shown); and microstrip circuits 400*a*, 400*b*, which are means for delivering the signals from the two chips 200*a*, 200*b* to the waveguide. It should be understood that the chips described herein do not only represent electronic circuit components in a traditional sense, each comprising a number of semiconductors such as transistors or the like, but also encompass, in their broadest sense, all types of components or elements that can exchange electromagnetic wave signals with each other.

According to one embodiment of the invention, a signal generated from the first chip 200*a* may be propagated along a feeding line and a probe of the first microstrip circuit 400*a*, and may be transmitted to the second chip 200*b* through the waveguide 300 as the signal transitions between the first microstrip circuit 400*a* and the waveguide 300.

Further, according to one embodiment of the invention, a signal transmitted through the waveguide 300 may be transmitted to the second chip 200*b* through the second microstrip circuit 400*b* as the signal transitions between the waveguide 300 and the second microstrip circuit 400*b*.

Next, the chip-to-chip interface apparatus according to one embodiment of the invention may be simplified into a two-port network model as shown in FIG. 1B. Referring to FIG. 1B, in the transition (i.e., Transition 1) between the first microstrip circuit (i.e., Microstrip 1) and the waveguide, input electromagnetic waves from the first microstrip circuit and from the waveguide may be expressed as $u_1^+$ and $w_1^-$, respectively, and the reflected waves for the input electromagnetic waves may be expressed as $u_1^-$ and $w_1^+$, respectively. Referring further to FIG. 1B, in the transition (i.e., Transition 2) between the second microstrip circuit (i.e., Microstrip 2) and the waveguide, input electromagnetic waves from the second microstrip circuit and from the waveguide may be expressed as $u_2^-$ and $w_2^+$, respectively, and the reflected waves for the input electromagnetic waves may be expressed as $u_2^+$ and $w_2^-$, respectively.

Configuration of a Microstrip Circuit

Hereinafter, the internal configuration of a microstrip circuit crucial for implementing the present invention and the functions of the respective components thereof will be discussed.

According to one embodiment of the invention, the microstrip circuit may comprise: a feeding line providing a signal; a probe being connected to one end of the feeding line; and a patch emitting the signal to the waveguide, wherein the patch is disposed in a layer (i.e., a third layer) opposite to a layer in which the feeding line and the probe are disposed (i.e., a first layer), with a core substrate being positioned therebetween.

Further, the microstrip circuit according to one embodiment of the invention may further comprise components for minimizing reverse traveling electromagnetic waves. Specifically, the microstrip circuit according to one embodiment of the invention may further comprise: a ground plane being disposed in the same layer as the patch (i.e., the third layer) and comprising an aperture surrounding the patch; and a slotted ground plane being disposed in a layer (i.e., a second layer) between the layer in which the feeding line and the probe are disposed (i.e., the first layer) and the layer in which the patch and the ground plane are disposed (i.e., the third layer), and comprising a slot for minimizing reverse traveling electromagnetic waves. In this case, according to one embodiment of the invention, the core substrate may comprise a first core substrate present between the first and second layers, and a second core substrate present between the second and third layers.

Furthermore, the microstrip circuit according to one embodiment of the invention may further comprise at least one via forming electrical connection between the ground plane and the slotted ground plane to prevent interference between channels in multi-channel communication.

Figure 2:
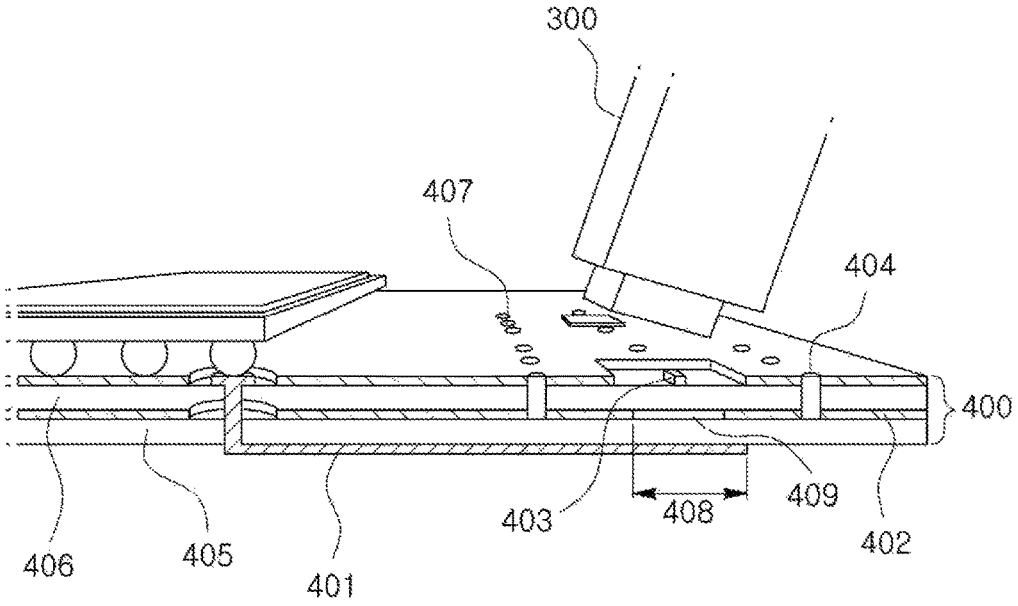
FIG. 2 illustratively shows the configuration of a microstrip circuit according to one embodiment of the invention.

FIG. 2 illustratively shows the configuration of a microstrip circuit 400 according to one embodiment of the invention.

Referring to FIG. 2, the microstrip circuit 400 according to one embodiment of the invention may comprise: a feeding line 401 being disposed in a first layer and providing a signal; a probe 408 being disposed in the first layer and connected to one end of the feeding line 401; a ground plane 404 being disposed in a third layer and comprising an aperture; a patch 403 being disposed in an area surrounded by the aperture in the third layer and emitting the signal to the waveguide 300; a slotted ground plane 402 being disposed in a second layer positioned between the first and third layers, and comprising a slot 409 for minimizing reverse traveling electromagnetic waves; at least one via 407 forming an electrical connection between the ground plane 404 and the slotted ground plane 402; a first core substrate 405 present between the first and second layers; and a second core substrate 406 present between the second and third layers.

Figure 3:
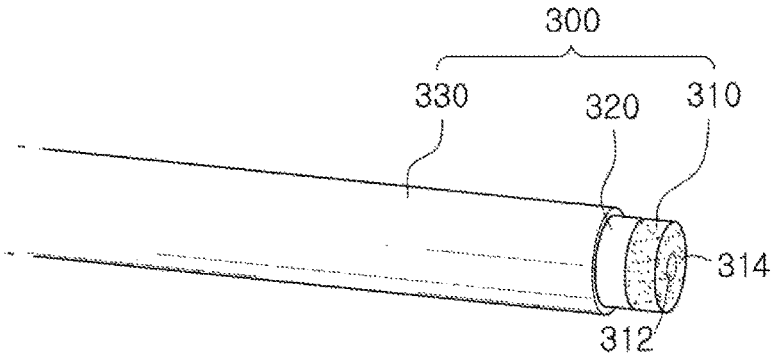
FIG. 3 illustratively shows the configuration of a waveguide according to one embodiment of the invention.

FIG. 3 illustratively shows the configuration of the waveguide according to one embodiment of the invention.

Referring to FIG. 3, the waveguide 300 according to one embodiment of the invention may comprise a dielectric part 310 consisting of dielectric. Further, the waveguide 300 according to one embodiment of the invention may comprise the dielectric part 310 comprising a first dielectric part 312 and a second dielectric part 314 having different permittivity, and a metal part 320 surrounding the dielectric part 310. For example, the first dielectric part 312 may be in the form of a core disposed at the center of the waveguide, and the second dielectric part 314 may be a component consisting of a material having permittivity different from that of the first dielectric part 312 and may be formed to surround the first dielectric part 312, while the metal part 320 may be a component consisting of metal such as copper and may be in the form of a cladding surrounding the second dielectric part 314.

Meanwhile, the waveguide 300 according to one embodiment of the invention may further comprise a jacket 330 consisting of a covering material enveloping the dielectric part 310 and the metal part 320.

Referring further to FIG. 3, the dielectric part 310 may be exposed where the waveguide 300 according to one embodiment of the invention is coupled to the microstrip circuit 400, without being surrounded by the metal part 320.

However, it is noted that the internal configuration or shape of the waveguide 300 according to the invention is not limited to the above description, and may be changed without limitation as long as the objects of the invention can be achieved. For example, at least one of both ends of the waveguide 300 may be tapered (i.e., linearly thinned) for impedance matching between the waveguide 300 and the microstrip circuit 400.

Meanwhile, referring to FIGS. 2 and 3, the microstrip circuit 400 (FIG. 2) according to one embodiment of the invention may be disposed at an impedance discontinuity surface between an electric transmission line and the waveguide 300, and in some cases, may be wired to a RF circuit (not shown) rather than the waveguide 300. Specifically, as shown in FIG. 2, the waveguide 300 according to one embodiment of the invention may be connected to the microstrip circuit 400 as aligned with the patch 403 of the microstrip circuit 400, and the patch 403 may emit a signal inputted at a resonant frequency to the waveguide 300. More specifically, the waveguide 300 according to one embodiment of the invention may be vertically connected to the first, second and third layers of the microstrip circuit 400, and a fixing means or connector (not shown) may be provided between the waveguide 300 and the microstrip circuit 400 to fix the connection state thereof.

Figure 4:
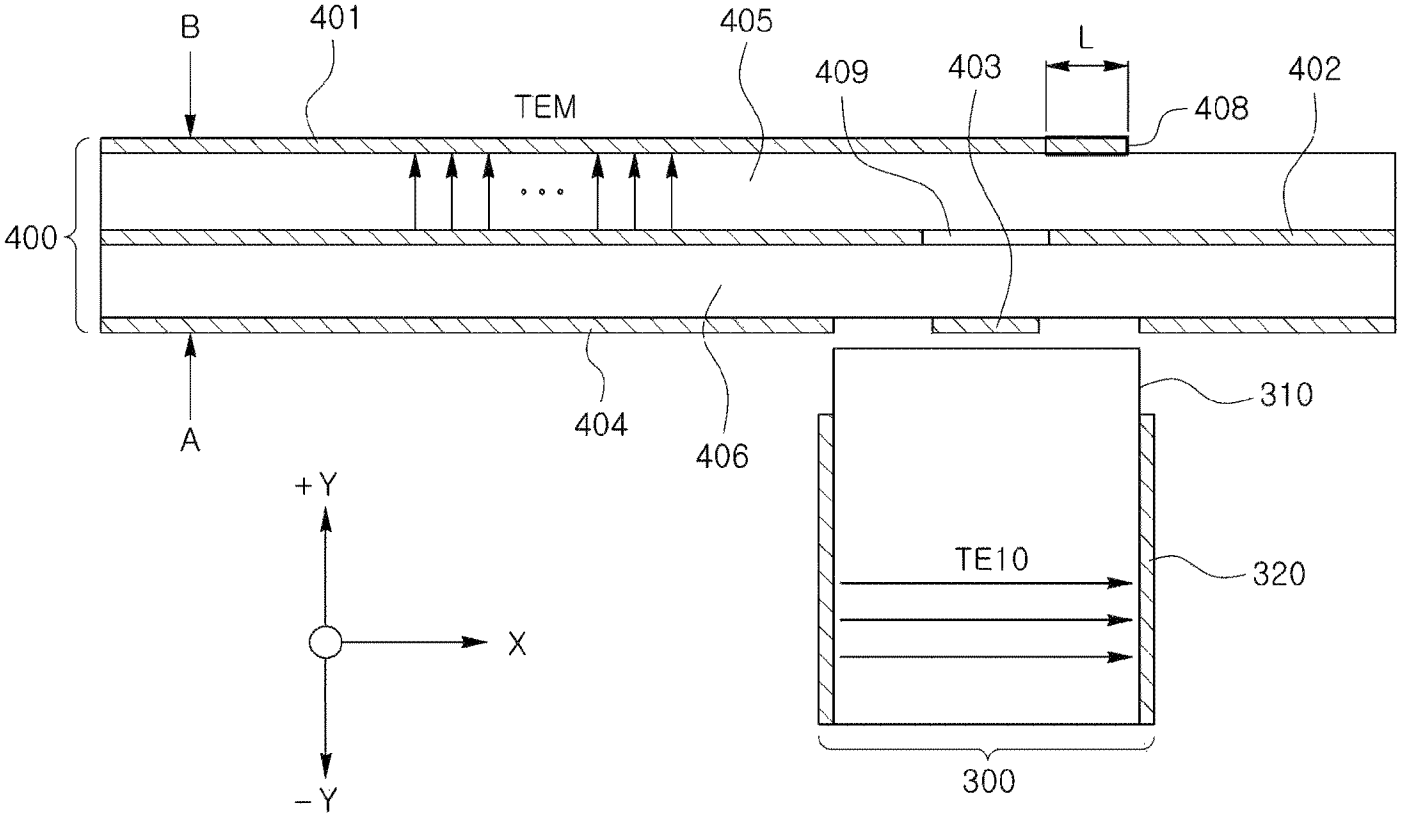
FIG. 4 illustratively shows a cross-sectional view of a microstrip circuit and a waveguide coupled to each other according to one embodiment of the invention.

FIG. 4 illustratively shows a cross-sectional view of the microstrip circuit and the waveguide coupled to each other according to one embodiment of the invention.

Figure 5:
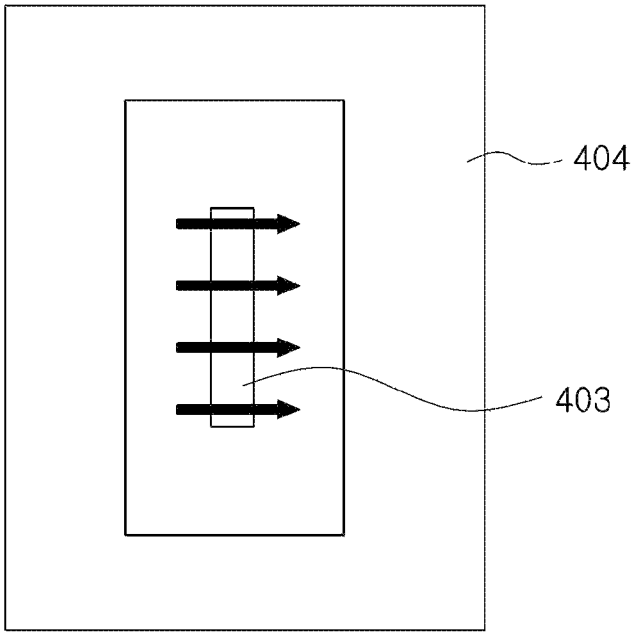
FIGS. 5 and 6 illustratively show a top and a bottom view of the microstrip circuit according to one embodiment of the invention, as seen from directions A and B in FIG. 4, respectively.
Figure 6:
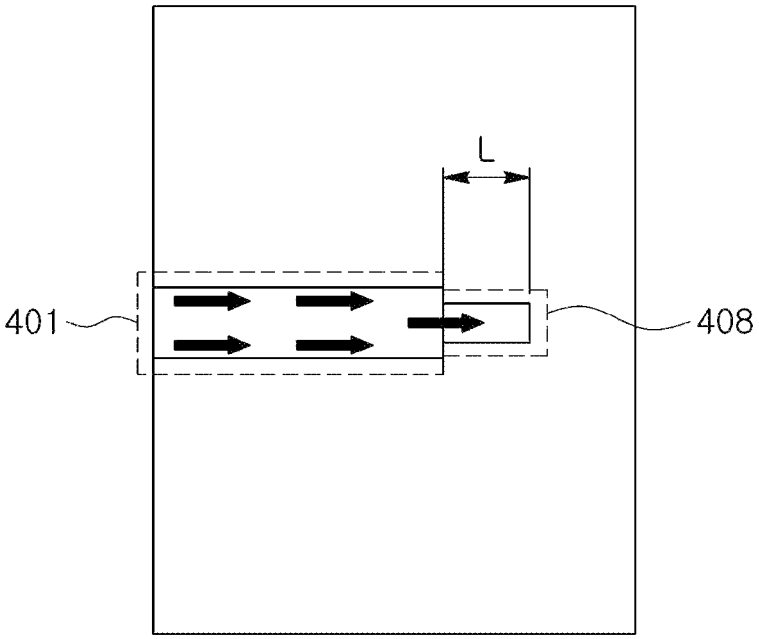

FIGS. 5 and 6 illustratively show a top and a bottom view of the microstrip circuit according to one embodiment of the invention, as seen from directions A and B (i.e., +Y and −Y directions, which are perpendicular to the direction of arrows in FIGS. 5 and 6) in FIG. 4, respectively.

Figure 7:
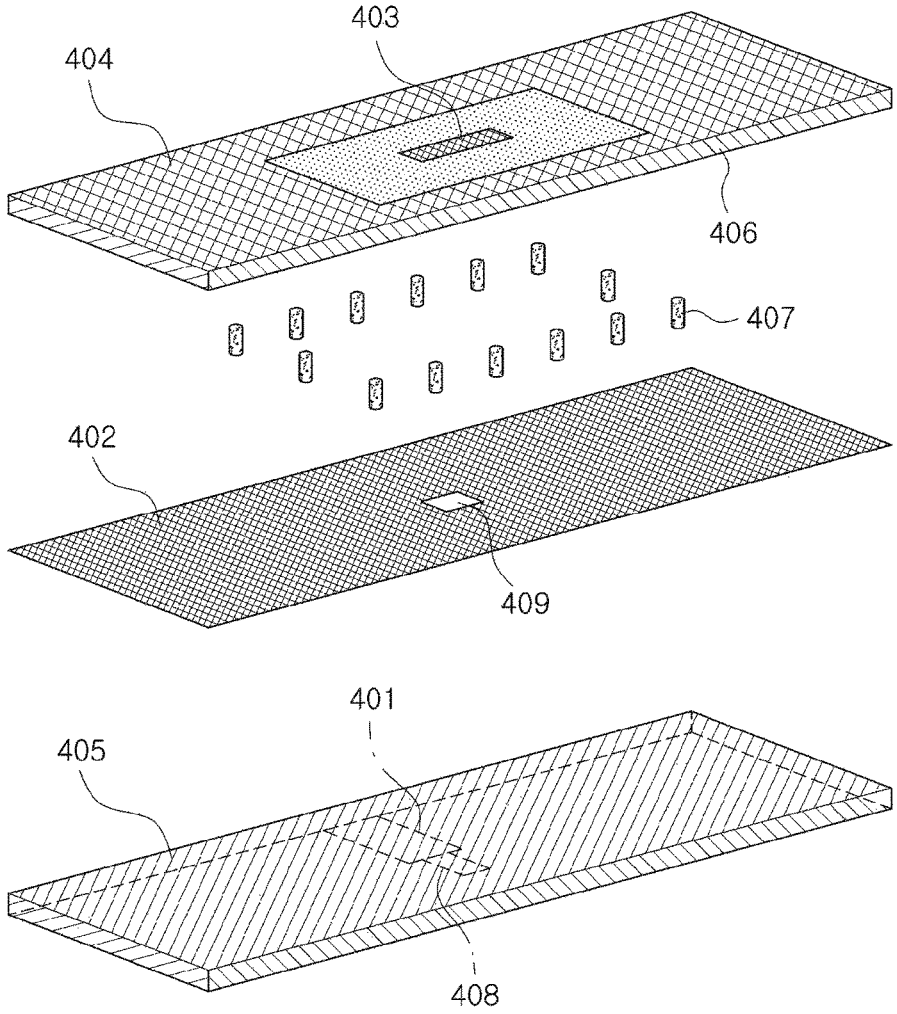
FIG. 7 shows an exploded view of a microstrip circuit according to one embodiment of the invention.

FIG. 7 shows an exploded view of the microstrip circuit according to one embodiment of the invention.

Referring to FIGS. 4 to 7, the microstrip circuit 400 (FIG. 4) according to one embodiment of the invention may have a triple-layer structure. Specifically, according to one embodiment of the invention, the feeding line 401 (FIGS. 4, 6 and 7) and the probe 408 (FIGS. 4, 6 and 7) may be disposed in the first layer of the microstrip circuit 400; the ground plane 404 (FIGS. 4, 5 and 7) comprising the aperture and the patch 403 (FIGS. 4, 5 and 7) present in an area surrounded by the aperture may be disposed in the third layer; and the slotted ground plane 402 (FIGS. 4 and 7) comprising the slot 409 (FIGS. 4 and 7) may be disposed in the second layer present between the first and third layers.

According to one embodiment of the invention, the patch 403 in the third layer may be coupled to the feeding line 401 in the first layer by means of current induced by current flowing in the feeding line 401 in a predetermined direction (e.g., the direction of the X-axis in FIG. 4, i.e., the direction of arrows in FIGS. 5 and 6), and a transmission signal inputted to the feeding line 401 in the first layer may be propagated to the patch 403 in the third layer according to the above coupling.

Further, according to one embodiment of the invention, the bandwidth of a first frequency band (e.g., an upper sideband) may be adjusted by the width and length L (FIGS. 4 and 6) of the probe 408 connected to one end of the feeding line 401, and the bandwidth of the first frequency band of the transmission signal may accordingly be adjusted. Specifically, according to one embodiment of the invention, the probe 408 may adjust a slope of an upper cut-off frequency band such that the transmission signal may sharply roll off at an upper cut-off frequency and a carrier frequency may be brought close to the upper cut-off frequency, thereby suppressing an upper sideband signal of the transmission signal. That is, the probe 408 according to one embodiment of the invention may cause a slope of an upper cut-off frequency band according to the characteristics of the waveguide 300 (FIG. 4) to sharply roll off, so that only a signal corresponding to a specific frequency band (e.g., a lower sideband) of the transmission signal may be transmitted to a receiving end. For example, for the above-described operation, the probe 408 according to one embodiment of the invention may have characteristic impedance greater than that of the feeding line 401.

Referring further to FIGS. 4 to 7, the size of the slot 409 provided in the slotted ground plane 402 and that of the aperture provided in the ground plane 404 may be optimized such that the ratio of reverse traveling electromagnetic waves to forward traveling electromagnetic waves may be minimized.

Referring further to FIGS. 4 to 7, the slot 409 and the patch 403 may form a stacked geometry, which may facilitate a bandwidth increase.

Referring further to FIGS. 4 to 7, the ground plane 404 and the slotted ground plane 402 may be electrically connected through at least one via 407. Here, the vias 407 (FIG. 7) may be disposed in the form of an array, and may be formed from the third layer.

Referring further to FIGS. 4 to 7, the cut-off frequency and impedance of the waveguide 300 may be determined according to the size of an intersection between the waveguide 300 and the microstrip circuit 400. Specifically, the number of TE (transverse electric) or TM (transverse magnetic) modes that may be transmitted (propagated) through the waveguide may be increased as the size of the above intersection is increased, thereby improving insertion loss of the transition. In FIG. 4, TEM denotes transverse electromagnetic modes in the transmission line, and TE10 denotes transverse electric modes in the waveguide.

Meanwhile, according to one embodiment of the invention, in the microstrip-to-waveguide transition (MWT) having a slot-coupled structure as shown in FIGS. 4 to 7, it is important to increase bandwidth of the transition by suppressing reflected electromagnetic waves generated from an impedance discontinuity surface. To this end, it is necessary to lower a quality factor of the chip-to-chip interface apparatus comprising the microstrip circuit 400 and the waveguide 300 by appropriately controlling (selecting) the length of the probe 408 and the thickness and permittivity of the first core substrate 405 (FIGS. 4 and 7) or the second core substrate 406 (FIGS. 4 and 7).

Figure 8:
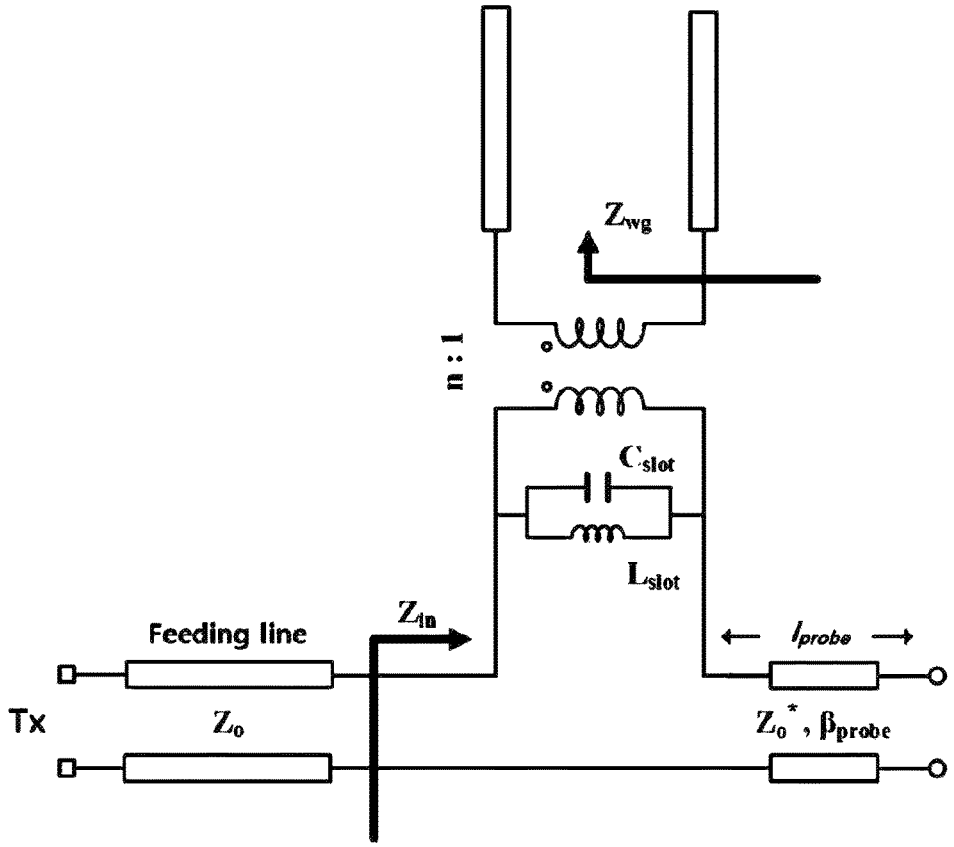
FIG. 8 shows an equivalent circuit model of a chip-to-chip interface apparatus comprising a microstrip circuit and a waveguide according to one embodiment of the invention.

FIG. 8 shows an equivalent circuit model of the chip-to-chip interface apparatus comprising the microstrip circuit and the waveguide according to one embodiment of the invention.

Referring to FIG. 8, $T_x$ denotes the transmission line; $Z_0$ denotes characteristic impedance of the feeding line; $Z_0$* denotes characteristic impedance of the probe; $Z_{in}$ denotes input impedance of the microstrip circuit; $Z_{wg}$ denotes impedance of the waveguide; n:1 denotes a turns ratio; $l_{probe}$ denotes a length of the probe; $\beta_{probe}$ denotes a propagation constant along the probe; $L_{slot}$ denotes inductance of the slot;

and $C_{slot}$ denotes capacitance of the slot. Referring further to FIG. 8, Eq. 1 shows how various parameters for detailed components of the microstrip circuit and the waveguide according to one embodiment of the invention are related to a quality factor of the chip-to-chip interface apparatus comprising the microstrip circuit and the waveguide. Eq. 1 can be simplified to Eqs. 2 to 4.

$$\frac{\partial Q_{eff}}{\partial x} = \frac{-\left(\frac{Z_0^*}{Z_0}\omega_0 L_{slot}\right)^2 n^2 Z_{wg} x}{\left(2\frac{Z_0^*}{Z_0}\omega_0 L_{slot} x\right)^2 \sqrt{\left(\frac{Z_0^*}{Z_0} n^2 Z_{wg} x\right)^2 - \frac{Z_0^*}{Z_0}\omega_0 L_{slot} n^2 Z_{wg}}} = \frac{-P_1}{Q_1\sqrt{R_1}} x \quad \text{(Eq. 1)}$$

$$Q_{eff} \simeq \frac{n^2 Z_{wg}}{\omega_0 L_{slot}} \quad \text{(Eq. 2)}$$

$$\frac{\partial Q_{eff}}{\partial \omega_0} = \frac{-n^2 Z_{wg}}{\omega_0^2 L_{slot}} < 0 \quad \text{(Eq. 3)}$$

$$\frac{\partial Q_{eff}}{\partial n^2} = \frac{Z_{wg}}{\omega_0 L_{slot}} > 0 \quad \text{(Eq. 4)}$$

In Eqs. 1 to 4, $Q_{eff}$ denotes a quality factor of the chip-to-chip interface apparatus comprising the microstrip circuit and the waveguide; x denotes a parameter specified by the length of the probe ($l_{probe}$) and the propagation constant along the probe ($\beta_{probe}$) (i.e., x=cot ($\beta_{probe} l_{probe}$)); $n^2$ denotes a coupling coefficient; and $\omega_o$ denotes a resonant frequency. Further, $\partial Q_{eff}/\partial x$ denotes a partial derivative of $Q_{eff}$ with respect to x, and shows a relationship between the quality factor and the cot ($\beta_{probe} l_{probe}$); and $P_1$, $Q_1$ and $R_1$ are representative values for simplifying Eq. 1. Furthermore, $\partial Q_{eff}/\partial \omega_o$ denotes a partial derivative of $Q_{eff}$ with respect to $\omega_o$, and shows a relationship between the quality factor and the resonant frequency; and $\partial Q_{eff}/\partial n^2$ denotes a partial derivative of $Q_{eff}$ with respect to $n^2$, and shows a relationship between the quality factor and the coupling coefficient.

First, referring to Eq. 1, when the length of the probe 408 is determined to be a half of a wavelength of a transitioning signal at the resonant frequency in the microstrip circuit 400 according to one embodiment of the invention, the value of the parameter x may be adjusted such that the quality factor may be minimized and bandwidth of the transition may be consequently increased.

Next, referring to Eqs. 2 to 4, the quality factor is inversely proportional to the resonant frequency in the microstrip circuit 400 according to one embodiment of the invention. Thus, it is necessary to increase the resonant frequency in order to increase the bandwidth of the transition between the waveguide 300 and the microstrip circuit 400.

Referring further to Eqs. 2 to 4, in the microstrip circuit 400 according to one embodiment of the invention, the quality factor is proportional to the coupling coefficient between the microstrip circuit 400 and the waveguide 300. Thus, when a substrate having great thickness and high permittivity is employed as the first core substrate 405 or the second core substrate 406, the coupling coefficient may be reduced and the bandwidth may be consequently increased. Therefore, according to one embodiment of the invention, the thickness and permittivity of the first core substrate 405 or the second core substrate 406 may be determined to be equal to or greater than predetermined levels, i.e., a first and a second predetermined level, respectively, so that the above coupling coefficient may not exceed a predetermined value.

Specifically, according to one embodiment of the invention, the thickness of the first core substrate 405 or the second core substrate 406 may be determined as a value corresponding to ⅙ of a wavelength of a signal traveling in the first core substrate 405 or the second core substrate 406. A core substrate having thickness greater than the above value may be referred to as an electrically thick core substrate.

For example, a substrate with thickness of 0.254 mm and permittivity of 10.2 at 10 GHz may be employed as the first core substrate 405 or the second core substrate 406.

Although details or parameters for the components included in the microstrip circuit according to one embodiment of the invention have been described above in detail, it is noted that the configuration of the microstrip circuit according to the invention is not necessarily limited to the above description, and may be changed without limitation as long as the objects or effects of the invention can be achieved.

Although the present invention has been described in terms of specific items such as detailed elements as well as the limited embodiments and the drawings, they are only provided to help more general understanding of the invention, and the present invention is not limited to the above embodiments. It will be appreciated by those skilled in the art to which the present invention pertains that various modifications and changes may be made from the above description.

Therefore, the spirit of the present invention shall not be limited to the above-described embodiments, and the entire scope of the appended claims and their equivalents will fall within the scope and spirit of the invention.

What is claimed is:

1. A microstrip circuit, comprising:

a feeding line providing a signal;

a probe being connected to one end of the feeding line; and a patch emitting the signal to a waveguide, the patch being disposed in a layer opposite to a layer in which the feeding line and the probe are disposed, with a core substrate being positioned therebetween, wherein at least one of a length of the probe, a thickness of the core substrate, and permittivity of the core substrate is determined based on a bandwidth of a transition between the microstrip circuit and the waveguide, and wherein the length of the probe is determined based on a wavelength of the signal at a resonant frequency thereof.

2. The microstrip circuit of claim 1, wherein the thickness and permittivity of the core substrate are determined based on a coupling coefficient between the waveguide and the microstrip circuit.

3. The microstrip circuit of claim 2, wherein the thickness of the core substrate is determined to be equal to or greater than a predetermined thickness, and the permittivity of the core substrate is determined to be equal to or greater than a predetermined permittivity, so that the coupling coefficient does not exceed a predetermined value.

4. The microstrip circuit of claim 1, further comprising:

a ground plane being disposed in the same layer as the patch and comprising an aperture surrounding the patch; and a slotted ground plane being disposed in a layer between the layer in which the feeding line and the probe are disposed and the layer in which the patch and the ground plane are disposed, and comprising a slot for minimizing reverse traveling electromagnetic waves, wherein the core substrate comprises:

a first core substrate present between the layer in which the feeding line and the probe are disposed and the layer in which the slotted ground plane is disposed; and a second core substrate present between the layer in which the slotted ground plane is disposed and the layer in which the patch and the ground plane are disposed.

5. The microstrip circuit of claim 4, further comprising:

at least one via forming an electrical connection between the ground plane and the slotted ground plane.

6. The microstrip circuit of claim 1, wherein the length of the probe is determined to be a half of the wavelength of the signal at the resonant frequency thereof.

7. The microstrip circuit of claim 1, wherein the waveguide is coupled to the microstrip circuit, and the waveguide comprises a dielectric part comprising a first and a second dielectric part having different permittivity, and a metal part surrounding the dielectric part.

8. The microstrip circuit of claim 1, wherein the bandwidth of the transition between the microstrip circuit and the waveguide is increased as a coupling coefficient between the waveguide and the microstrip circuit is reduced.

9. The microstrip circuit of claim 1, wherein the bandwidth of the transition between the microstrip circuit and the waveguide is increased as the resonant frequency of the signal is increased.

10. A chip-to-chip interface apparatus, comprising:

a waveguide; and a microstrip circuit, comprising:

a feeding line providing a signal;

a probe being connected to one end of the feeding line; and a patch emitting the signal to a waveguide, the patch being disposed in a layer opposite to a layer in which the feeding line and the probe are disposed, with a core substrate being positioned therebetween, wherein at least one of a length of the probe, a thickness of the core substrate, and permittivity of the core substrate is determined based on a bandwidth of a transition between the microstrip circuit and the waveguide, wherein the length of the probe is determined based on a wavelength of the signal at a resonant frequency thereof, and wherein the waveguide is coupled to the microstrip circuit, and the waveguide comprises a dielectric part comprising a first and a second dielectric part having different permittivity, and a metal part surrounding the dielectric part.

* * * * *